US005085182A

United States Patent [19]

Nakamura et al.

[11] Patent Number: 5,085,182

[45] Date of Patent: Feb. 4, 1992

[54] VARIABLE VALVE TIMING ROCKER ARM ARRANGEMENT FOR INTERNAL COMBUSTION ENGINE

[75] Inventors: Makoto Nakamura; Shigeru Sakuragi; Yutaka Matayoshi, all of Yokosuka; Keiichi Maekawa, Yokohama; Seinosuke Hara; Shoji Morita, both of Atsugi, all of Japan

[73] Assignees: Nissan Motor Co., Ltd., Yokohama; Atsugi Unisia Corp., Atsugi, Japan

[21] Appl. No.: 587,939

[22] Filed: Sep. 25, 1990

[30] Foreign Application Priority Data

Sep. 25, 1989 [JP] Japan ..... 1-248677

[51] Int. Cl.[5] ..... F01L 1/34; F01L 1/18

[52] U.S. Cl. ..... 123/90.16; 123/90.39

[58] Field of Search ..... 123/90.15, 90.16, 90.39

[56] References Cited

U.S. PATENT DOCUMENTS

| | | | |
|---|---|---|---|
| 4,151,817 | 5/1979 | Mueller | 123/90.16 |
| 4,203,397 | 5/1980 | Soeters, Jr. | 123/90.16 |
| 4,617,880 | 10/1986 | Yoshizaki | 123/90.16 |
| 4,726,332 | 2/1988 | Nishimura et al. | 123/90.16 |
| 4,768,475 | 9/1988 | Ikemura | 123/90.16 |
| 4.844,023 | 7/1989 | Konno et al. | 123/90.16 |
| 4,911,112 | 3/1990 | Oikawa et al. | 123/90.16 |

FOREIGN PATENT DOCUMENTS

| | | |
|---|---|---|
| 0318303 | 5/1989 | European Pat. Off. . |
| 63-57805 | 3/1988 | Japan . |
| 63-167016 | 7/1988 | Japan . |
| 63-45521 | 11/1988 | Japan . |
| 2185784A | 7/1987 | United Kingdom . |
| 2197686A | 5/1988 | United Kingdom . |

*Primary Examiner*—E. Rollins Cross
*Assistant Examiner*—Weilun Lo
*Attorney, Agent, or Firm*—Foley & Lardner

[57] ABSTRACT

A main rocker arm which is pivotally mounted on a rocker shaft has one or more sub-rocker arms pivotally mounted thereon. The main rocker arm is arranged to synchronously open and close two poppet valves. Each of the sub-rocker arms can be selectively locked to the main one by way of hydraulically operated plunger arrangements. The main rocker arm is provided with a roller type cam follower which follows a low speed cam. The sub-rocker arms are provided with followers which engage high or very high speed cams. Lost motion springs which maintain the sub-rocker arms in contact with the cams are mounted on the main rocker arm.

7 Claims, 7 Drawing Sheets

VARIABLE VALVE TIMING ROCKER ARM ARRANGEMENT FOR INTERNAL COMBUSTION ENGINE

BACKGROUND OF THE INVENTION

1. Field of the Invention

The present invention relates generally to a variable valve timing arrangement for an internal combustion engine and more specifically to a rocker arm construction for such an arrangement.

2. Description of the Prior Art

JP-A-63-167016 and JP-A-63-57805 disclosed rocker arm arrangements which include a first rocker arm which is arranged to cooperate with a low speed cam and a second rocker arm which cooperates with a high speed cam. The two rocker arms pivotally mounted on a common rocker arm shaft.

A hydraulically operated connection device which enables the first and second rocker arms to be selectively locked together, comprises a set of plunger bores which are formed in the rocker arms in a manner to be parallel with and at a predetermined distance from the axis of the shaft about which the arms are commonly pivotal. By applying a hydraulic pressure to the end or ends of the plungers reciprocally disposed in the bores, the plungers can be induced to move axially within their bores and induce the situation wherein two of the plungers will partially enter an adjacent bore and lock the two arms together.

However, this arrangement has suffered from the drawbacks that as the rocker arms are pivotally mounted on a rocker arm shaft minor variations in the rocker arm dimensions lead to variations in the opening and closing timing of the engine valves; and in that the rocker arms become relatively large and exhibit large moments.

In addition to this, seats for the lost motion springs which are operatively connected with the high speed rocker arms must be provided on the cylinder head. This of course increases the complexity of forming and arranging the upper surface of the cylinder head.

SUMMARY OF THE INVENTION

It is an object of the present invention to provide a rocker arm arrangement which enables the construction of the cylinder head to be simplified and the assembly of the valve train on the cylinder head to be facilitated.

In brief, the above objects are achieved by an arrangement wherein a main rocker arm which is pivotally mounted on a rocker shaft has one or more sub-rocker arms pivotally mounted thereon. The main rocker arm is arranged to synchronously open and close two poppet valves. Each of the sub-rocker arms can be selectively locked to the main one by way of hydraulically operated plunger arrangements. The main rocker arm is provided with a roller type cam follower which follows a low speed cam. The sub-rocker arms are provided with followers which engage high or very high speed cams. Lost motion springs which maintain the sub-rocker arms in contact with the cams are mounted on the main rocker arm.

More specifically, a first aspect of the present invention comes in an internal combustion engine having a cylinder head and a poppet valve which is associated with the cylinder head and a rocker shaft and which features: a first rocker arm, the first rocker arm being pivotally mounted on the rocker shaft, arranged to engage a stem of the poppet valve and to engage a first cam having a profile suited for low speed engine operation; a second rocker arm, the second rocker arm being pivotally mounted on the first rocker arm arranged to engage a second cam having a profile suited for high speed engine operation; hydraulically operated engagement means for selectively connecting the first and second rocker arms in a manner wherein relative movement therebetween is prevented; and a lost motion spring mounted on the first rocker arm and arranged to engage the second rocker arm in a manner which biases the second rocker arm against the second cam.

A second aspect of the present invention comes in a valve train for an internal combustion engine which features: a first rocker arm, the first rocker arm being motivated by a first cam having a profile suited for low speed engine operation, the first rocker arm being pivotally mounted on a rocker shaft; a second rocker arm, the second rocker arm being arranged to be motivated by a second cam having a profile suited for high speed engine operation, the second rocker shaft being pivotally mounted on the first rocker arm; a third rocker arm, the second rocker arm being arranged to be motivated by a third cam having a profile suited for high speed engine operation, the third rocker shaft being pivotally mounted on the first rocker arm; a first hydraulically operated interlocking device which selectively interconnects the first and second rocker arms in a manner wherein relative movement therebetween is prevented; a second hydraulically operated interlocking device which selectively interconnects the first and third rocker arms in a manner wherein relative movement therebetween is prevented; a first lost motion spring mounted on the first rocker arm and arranged to engage the second rocker arm in a manner which biases the second rocker arm against the second cam; and a second lost motion spring mounted on the first rocker arm and arranged to engage the third rocker arm in a manner which biases the third rocker arm against the third cam.

DESCRIPTION OF THE PREFERRED EMBODIMENTS

Figure 1:
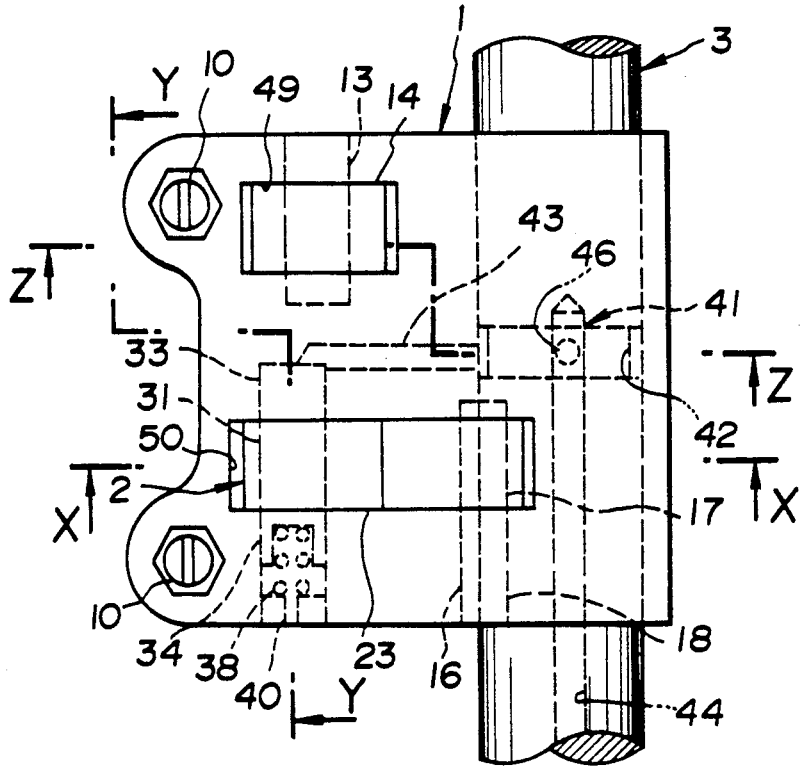
FIG. 1 is a plan view of a rocker arm arrangement according to a first embodiment of the present invention.
Figure 2:
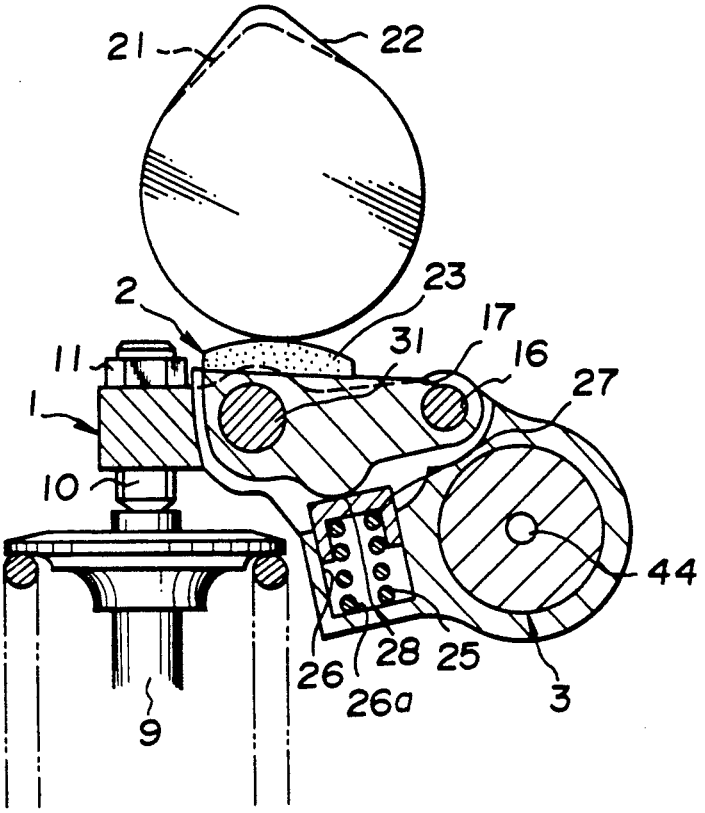
FIG. 2 is a side sectional view as taken along line X—X of FIG. 1.
Figure 3:
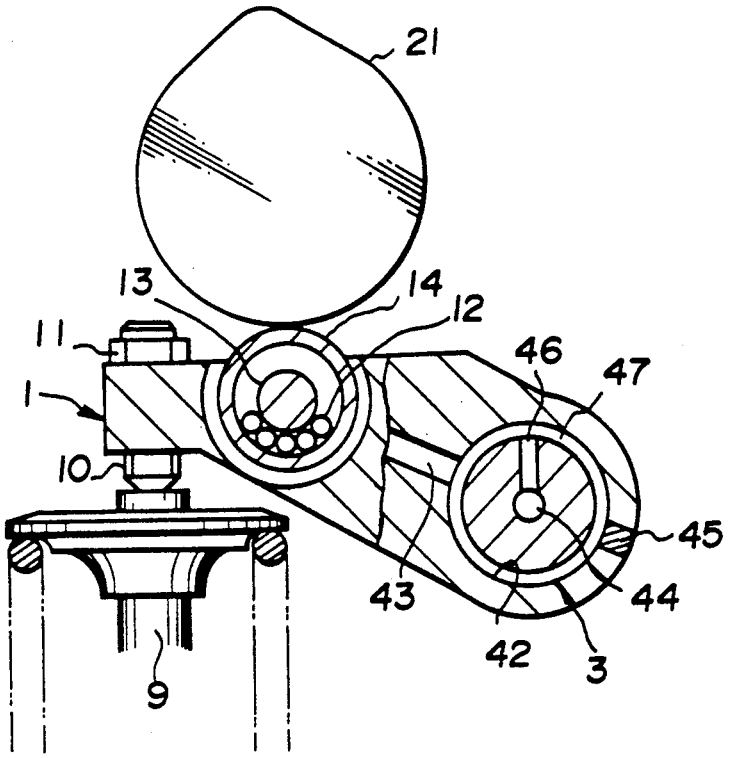
FIG. 3 is a side sectional view as taken along line Z—Z of FIG. 1.

FIGS. 1-6 show a first embodiment of the present invention. This embodiment takes the form of a rocker arm which is arranged to synchronously open and close two poppet valve 9. These valves 9 may be either inlet or exhaust valves.

A main rocker arm 1 is arranged so that one end there of engages both of the valves while the other is pivotally supported on the cylinder head by way of main rocker shaft 3. The ends of the main rocker arm which engages the valves are provided with adjust screws and locknuts 11. A roller 14 is rotatably mounted on the main rocker arm 1 by way of needle bearings 12. This roller is arranged to act as a follower which engages a low speed cam 21 (viz., a cam which is configured for low speed engine operation).

A will be appreciated from the plan view of FIG. 1 the main rocker arm 1 has an essentially rectangular shape. A sub-rocker arm 2 is pivotally supported on the main rocker arm 1 by way of a sub-rocker arm shaft 16. The shaft 16 is received in a bore 17 formed in the sub-rocker arm 2 and a coaxial bore 18 formed in the main rocker arm 1.

The sub-rocker arm 2 does not directly engage the valves 9 and is formed with a convexly shaped cam follower portion 23 which is arranged to engage a high speed cam 22.

A lost motion spring 25 is received in a blind bore or recess 26 formed in the main rocker arm 1. In this embodiment the lost motion spring 25 is a coil spring. The lower end of the spring engages the blind end wall of the bore 26 while a retainer 27, which is reciprocatively disposed in the upper end of the bore 26, encloses the upper end of the same. A follower 28 is formed on the underside of the sub-rocker arm 2 and arranged to engage the top of the retainer 27.

Figure 4:
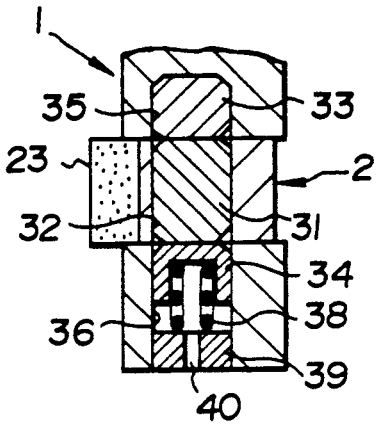
FIGS. 4 and 5 are sectional views as taken along section line Y—Y of FIG. 1 showing the interlocking arrangement which interconnects the high and low speed rocker arms condition for low and high speed operation, respectively.
Figure 5:
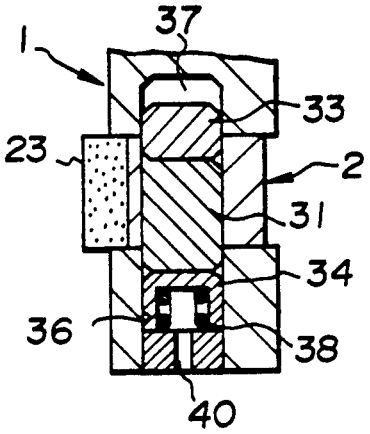

An interlocking arrangement for selectively interconnecting the main and sub-rocker arms 1, 2 comprises a structure of the nature shown in FIGS. 4 and 5. As shown, this structure includes a plunger 31 which is reciprocatively received in a though bore 32 formed in the sub-rocker arm 2, and plungers 33, 34 which are respectively received in bores 35, 36 formed in the main rocker arm 1. The plunger 33 defines a variable volume hydraulic fluid chamber 37 in the bore 35. On the other hand, a return spring 38 is disposed in the bore 36 between the plunger 34 and a plug 39 in which an air vent bore 40 is formed.

When the pressure prevailing in the hydraulic chamber 37 is below a level at which the bias of the return spring 38 is overcome, the plungers 31, 33 and 34 assume the positions shown in FIG. 4. As will be appreciated, the plunger 33 and the bore are dimensioned so that when the hydraulic pressure is below the above mentioned level, the end face which engages one of the end faces of the plunger 31, lies flush with the wall surface of the main rocker arm 1 in which the bore 33 is formed. The plunger 31 is dimensioned so that under these conditions its end faces lie flush with the side walls of the sub-rocker arm 2. This of course maintains the plunger 34 in a state wherein its end face lies flush with the wall surface of the main rocker arm in which the bore 36 is formed.

Under these conditions the sub-rocker arm 2 is rendered pivotal with respect to the main rocker arm 1 and thus can be driven down against the bias of the lost motion spring 25 under the influence of the high speed cam 22 engaging the cam follower 23.

On the other hand, when hydraulic pressure is supplied into the hydraulic chamber 37 and produces a bias which overcomes the force of the return spring 38, the plungers 31, 33 and 34 move to the positions illustrated in FIG. 5. As will be appreciated this shift taken place when the cam followers 14, 23 engage the base circle portions of the low and high speed cams 21, 22 respectively. This shifting of the plungers locks the two rocker arms together. In this state the movement of the main rocker arm 1 is determined by the engagement between the high speed cam 22 and the follower 23 formed on the sub-rocker arm.

A hydraulic passage structure generally denoted by the numeral 41 in FIG. 1 provides fluid communication between the hydraulic chamber 37 and a non-illustrated control source. As shown, this passage structure comprises: a passage 43 formed in the main rocker arm which leads from one end of the bore in which the hydraulic chamber 37 is defined to a horizontally large diameter bore 42 in which the rocker shaft 3 is disposed; an axial bore which defines an oil gallery 44 in the rocker shaft 3; an annular recess formed about the rocker shaft 3; and a radial bore 46 which provides fluid communication between the oil gallery 44 and the recess 47. Passage 43 communicates with the recess 47. A plug 45 closes the drill hole produced when the passage 43 is formed in the main rocker arm.

Figure 6:
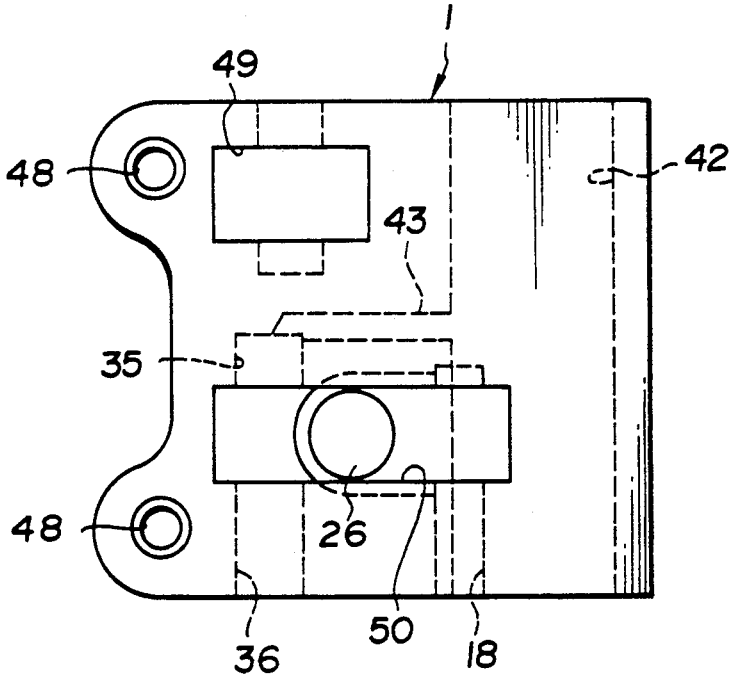
FIG. 6 is a plan view showing the main rocker arm of the first embodiment.

FIG. 6 shows the structure of the main rocker arm. In this figure, 48 denote the threaded bores in which the adjust screws 10 are received, 49 denotes the recess in which the roller 14 is disposed and 50 denotes the opening in which the sub-rocker arm 2 is received.

The above mentioned control source comprises a switching valve (not shown) which is fluidly interposed between the chamber 37 and an oil pump. The valve is controlled by a control unit which receives data inputs indicative of engine speed, coolant temperature, lubricant oil temperature, supercharge pressure, engine throttle valve position. This control unit determines when it is necessary to switch between high and low cam lifting.

The low and high speed cams 21, 22 are both formed integrally on a cam shaft and have profiles which are designed to produce the appropriate amount of lift and timing for low and high engine speed operation, respectively. Viz., the amount of lift and/or the length of time the valve is opened by the high speed cam 22 is greater than that induced the low speed one.

OPERATION

During low speed engine operation, the pressure in the hydraulic chamber 37 is reduced to a level whereat the plungers 31, 33 and 34 assume the positions illustrated in FIG. 4. As a result the sub-rocker arm 3 is left unlocked from the main one 1 and is permitted to pivot relative to the main rocker arm 1 against the bias of the lost motion spring 25. The movement of the main rocker arm 1 and the lifting of the valves 9 is therefore determined by the low speed cam 21.

When the engine operation changes to a high speed mode, the pressure which is supplied to the hydraulic chamber 37 is increased to a level whereat return spring 38 is overcome and the plungers are induced to assume the positions shown in FIG. 5. This locks the main and sub-rocker arm 1, 2 in a manner wherein the larger pivotal motion of the sub-rocker arm 2 is superimposed on the main one 1 and the valve 9 are subject to lifting control by the high speed cam 22.

When the engine speed lowers to a low speed zone, the pressure in the hydraulic chamber 37 is reduced and the return spring 37 returns the three plungers to the positions shown in FIG. 4. This of course unlocks the main and sub-rocker arms and permits the valve lifting to be controlled by low speed cam 21.

Figure 7:
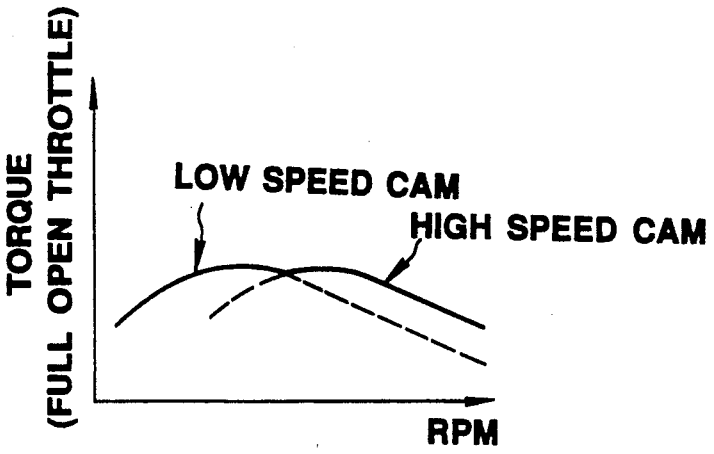
FIG. 7 is a graph showing in terms of engine speed and engine torque, the characteristics which are provided with the first embodiment of the present invention.

With the above described embodiment, the engine performance characteristics shown in FIG. 7 are obtained. That is to say, by switching between the high and low speed cams it is possible to maintain the level of torque produced by the engine at a much more uniform level than is possible using one one cam.

As the sub-rocker arm 2 (high speed rocker arm) is pivotally supported on the main rocker arm 1 (low speed rocker arm) per se by way of the sub-rocker shaft 16 it is possible to greatly reduce the size and mass of the same. As a result, the mass of the sub-rocker arm is lower than that of the prior art discussed in the opening paragraphs of the instant disclosure. This enables the mass of the valve train to be reduced. Further, during high speed modes of operation when the two rocker arms are locked together so as to move as a single unit, as the mass of each unit is reduced as compared with said prior art the valve following characteristics are improved.

On the other hand, during low speed modes of engine operation even though the mass of the sub-rocker arm 2 increases the oscillating mass of the main rocker arm 1, as the speed at which the valves are opened and closed is relatively low there is not detrimental effect on the valve following characteristics.

In addition to the above, as the sub-rocker is relatively small and light, the lost motion spring can be relatively small and weak. This reduces the amount of friction which is produced between the high speed cam 22 and the follower 23 and thus reduces engine fuel consumption.

Further, as the sub-rocker arm 2 is pivotally mounted on the main rocker arm 1 by way of sub-rocker shaft 16, it is possible to assembly the both to form a unit which can be then mounted on the rocker shaft. The precision with which the roller 14 and follower 23 are mounted on the respective rocker arms can be checked before the unit is actually mounted on the cylinder head. This reduces the amount of work which must be done in order to ensure uniform lift characteristics from cylinder to cylinder. That is to say, with the above mentioned prior art, these factors cannot be checked until both rocker arms are mounted on the cylinder head.

The fact that the lost motion spring 25 does not require a seat to be formed on the cylinder head per se, reduces the amount of variation during assembly.

In addition, as the plungers 31, 33 and 34 and the return spring can be assembled as a unit, the amount of time required for assembling valve train on the cylinder head is reduced.

SECOND EMBODIMENT

Figure 8:
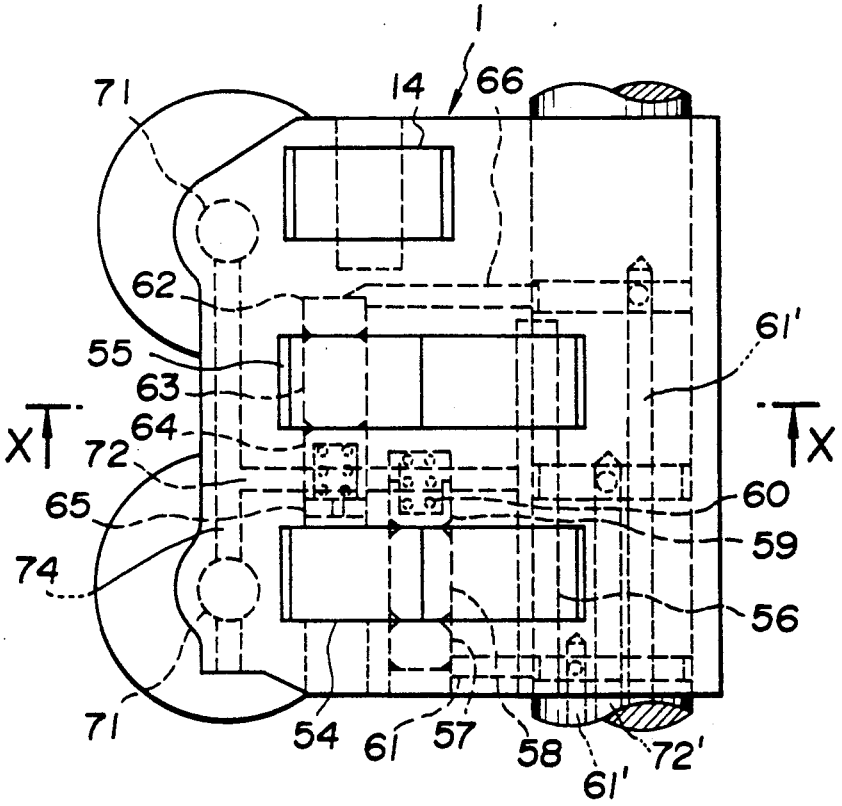
FIG. 8 is a plan view showing a second embodiment of the present invention.
Figure 9:
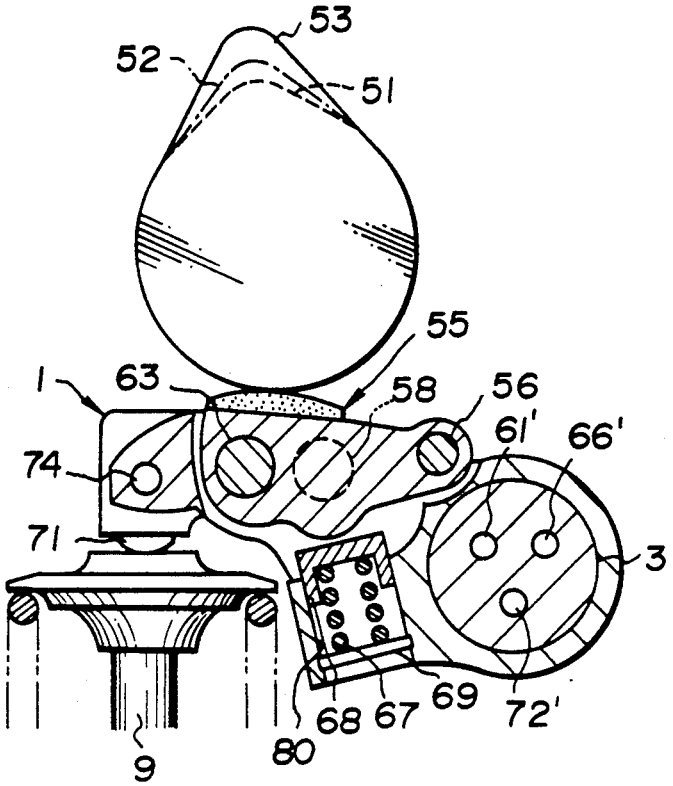
FIG. 9 is a sectional view as taken along section line X—X of FIG. 8.

FIGS. 8 and 9 show a second embodiment of the present invention. In this embodiment three cams are provided on the cam shaft. A first low speed cam 51, a second high speed cam 52 and a third very high speed cam 53. The rocker arm arrangement comprises a main rocker arm 1 on which a first cam follower (roller) 14 is mounted; and first and second sub-rocker arms 54, 55 which are arranged to cooperate with the second and third cams 52, 53, respectively.

The sub-rocker arms 54, 55 are pivotally mounted on the main rocker arm 1 by way of a common sub-rocker shaft 56.

Plungers 57, 58 and 59 and a return spring 60 are arranged to provide selective interlocking between the main and first sub-rocker arms 1, 54. The movement of the plungers is controlled by hydraulic pressure which is supplied through a control passage 61.

Plungers 62, 63 and 64 and a return spring 65 are arranged to provide selective interlocking between the main and second sub-rocker arms 1, 55. The movement of these plungers is controlled by hydraulic pressure which is supplied through a control passage 66.

The second sub-rocker arm 55 cooperates with a lost motion spring arrangement comprised of a spring 67, a retainer 68, and a stopper 69. As will be appreciated from FIG. 9, the bore in which the spring and the retainer are disposed is not blind and the stopper 69 is provided close one end of said bore. The first rocker arm is arranged to cooperate with a similar non-illustrated lost motion spring arrangement.

Figure 10:
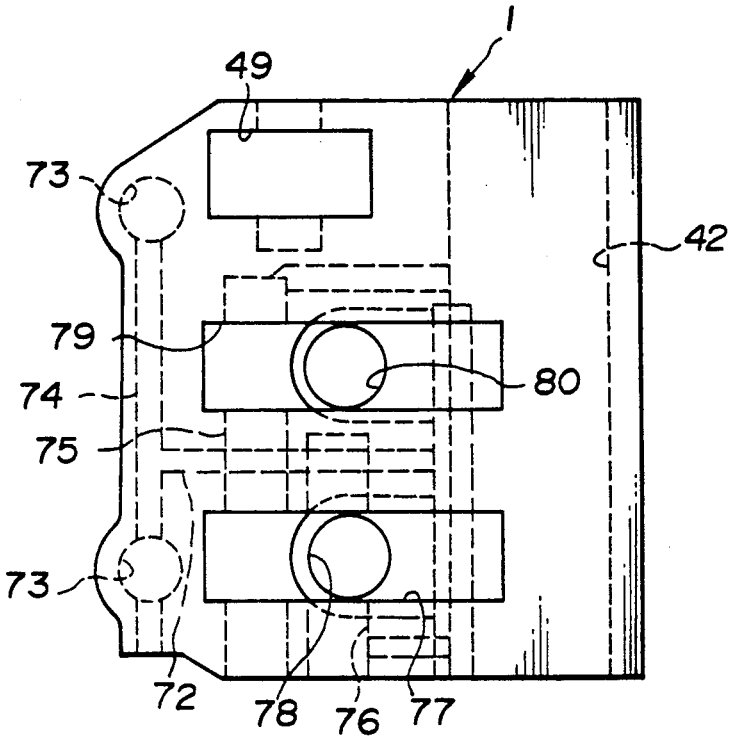
FIG. 10 is a plan view showing the main rocker arm used in the second embodiment.

The main rocker arm 1 is provided with hydraulic lash adjusters 71 which engage the tops of the valves 9. These devices are supplied with hydraulic fluid under pressure by way of passages 72, 74 as shown in FIG. 10. In this latter mentioned figure, numerals 75 and 76 generally denote the bores in which the plungers 62, 63 and 74 and 57, 58 and 59 are disposed.

It should be further noted that in FIG. 10 the passage 72 is shown as passing below the bores 75 and 76; that 49 denotes the opening in which the roller 14 is disposed; 77 is the opening in which the first sub-rocker arm 54 is disposed; 78 is the bore in which the first lost motion spring arrangement is received; 79 is the opening in which the second rocker arm 55 is received; and 80 is the bore in which the second lost motion spring arrangement is disposed.

Passages 61, 66 and 72 are arranged to communicate with oil galleries 61', 66' and 72' which are formed in the rocker shaft 3.

Figure 11:
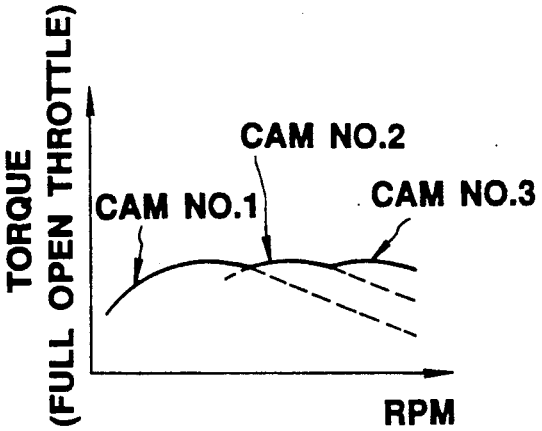
FIG. 11 is a graph which shows in terms of engine speed and engine torque, the engine operational characteristics which are provided by the second embodiment at low, high and very high engine speeds, respectively.

This arrangement is such that the cams 51, 52 and 53 are used during low, high and very high engine speed operations, respectively. By appropriately configuring these cams, it is possible to achieve the torque output characteristics shown in FIG. 11.

Figure 12:
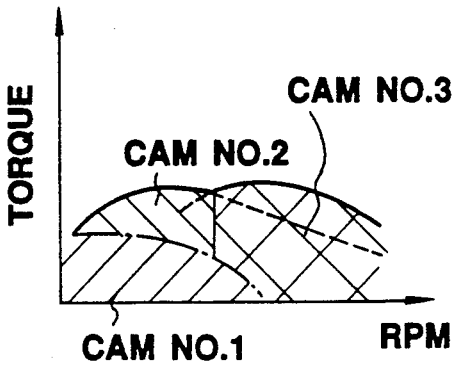
FIG. 12 is a graph which shows in terms of engine speed and engine torque the engine operational characteristics which can be provided during idling, low speed/high load and high speed/high load modes of engine operation by the second embodiment of the present invention.

Further, by configuring the first cam 51 to provide a small low lift over a small crankangle range, it is possible to improve combustion characteristics during idling;

and by configuring the cam 52 to provide appropriate lift for low speed/high load and cam 53 to provide the appropriate lift for high speed high load, the power output characteristics shown in FIG. 12 are rendered possible.

THIRD EMBODIMENT

Figure 13:
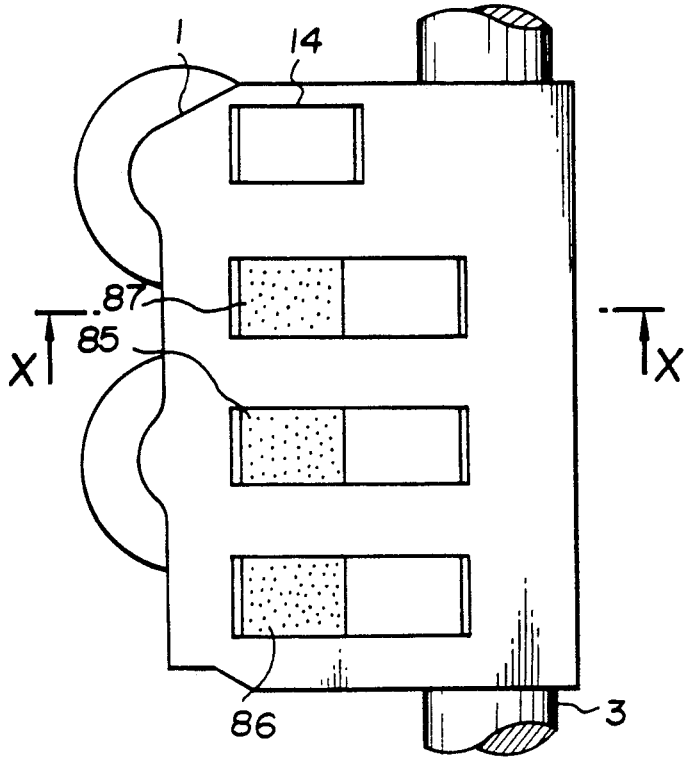
FIG. 13 is plan view of a third embodiment of the present invention.
Figure 14:
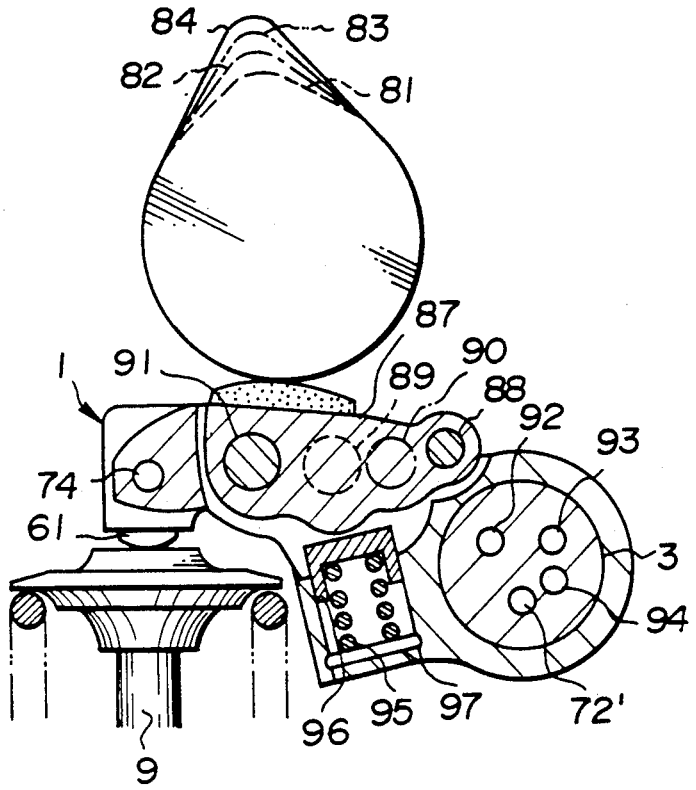
FIG. 14 is a sectional view as taken along section line X—X of FIG. 13.

FIGS. 13 and 14 show a third embodiment of the present invention. This embodiment is essentially similar to the second one and differs in that four cams and three sub-rocker arms are utilized. In this embodiment, cams 81, 82, 83 and 84 are provided on the cam shaft. The first cam 81 cooperates with the roller 14 of the main rocker arm 1, while cams 82–84 cooperate with the three sub-rocker arms 85, 86 and 87. Cam 81 is configured for low speed engine operation while cams 82–84 are configured from sequentially increasing high speed operational modes.

The three sub-rocker arms are respectively interlocked with the main rocker arm 1 by way of plunger sets 89, 90 and 91. Each of these are offset with respect to one another in essentially the same manner as the plunger sets of the second embodiment are.

The plunger sets 89, 90 and 91 are supplied with control pressures via passage 92, 93 and 94 (formed in the rocker shaft). Passage 72' supplies hydraulic pressure to the hydraulic lash adjusters 61. The three sub-rocker arms cooperate with lost motion spring arrangements. In FIG. 14 the lost motion spring arrangement which cooperates with sub-rocker arm 87 is shown. This arrangement comprises a spring 95, a retainer 96 and a stopper 97.

Figure 15:
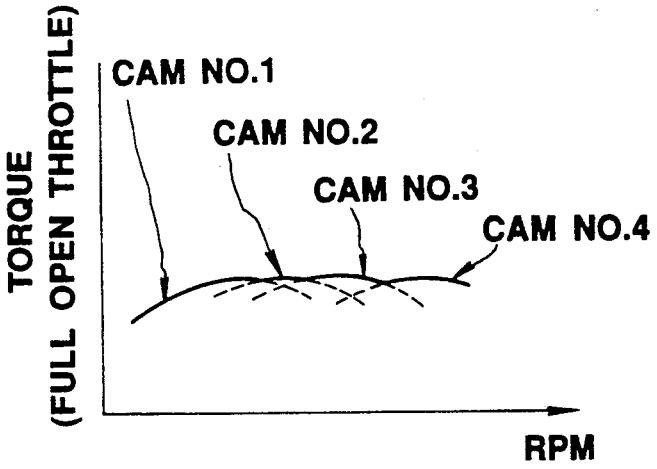
FIG. 15 is a graph showing the engine torque generation characteristics achieved with the third embodiment.

The engine torque output characteristics possible with the instant embodiment are shown in FIG. 15.

What is claimed is:

1. In an internal combustion engine having a cylinder head and a poppet valve which is associated with said cylinder head and a rocker shaft:

a first rocker arm, said first rocker arm being pivotally mounted on the rocker shaft, arranged to engage a stem of the poppet valve and to engage a first cam having a profile suited for low speed engine operation;

a second rocker arm, said second rocker arm being pivotally mounted on said first rocker arm, arranged to engage a second cam having a profile suited for high speed engine operation;

hydraulically operated engagement means for selectively connecting said first and second rocker arms in a manner wherein relative movement therebetween is prevented; and a lost motion spring mounted on said first rocker arm and arranged to engage said second rocker arm in a manner which biases said second rocker arm against said second cam.

2. An internal combustion engine as claimed in claim 1 wherein said hydraulically operated interlocking means comprises:

a first bore formed in said first rocker arm;

a first plunger reciprocatively disposed in said first bore in a manner to define a hydraulic chamber which is in fluid communication with a passage;

a second bore formed in said second rocker arm, said second bore being formed in said second rocker arm so as to be alignable with said first bore;

a second plunger reciprocatively disposed in said second bore, said second plunger having first end which is abutable with an end of said first plunger, said second plunger having a length which is essentially the same as the length of the second bore;

a third bore formed in said first rocker arm, said third bore being formed so as to be alignable with said second bore;

a third plunger reciprocatively disposed in said third bore, said third plunger having a first end which is abutable with a second end of said second plunger; and a return spring disposed in said third bore and arranged to produce a bias which acts on a second end of said third plunger.

3. A valve train as claimed in claim 2 further comprising passage means defined in said first rocker arm and the rocker shaft on which said first rocker arm is pivotally mounted, said passage means being arranged to supply control pressure to said hydraulic chamber.

4. In a valve train for an internal combustion engine:

a first rocker arm, said first rocker arm being motivated by a first cam having a profile suited for low speed engine operation, said first rocker arm being pivotally mounted on a rocker shaft;

a second rocker arm, said second rocker arm being arranged to be motivated by a second cam having a profile suited for high speed engine operation, said second rocker shaft being pivotally mounted on said first rocker arm;

a third rocker arm, said third rocker arm being arranged to be motivated by a third cam having a profile suited for a higher speed engine operation than said second cam, said third rocker shaft being pivotally mounted on said first rocker arm;

a first hydraulically operated interlocking device which selectively interconnects said first and second rocker arms in a manner wherein relative movement therebetween is prevented;

a second hydraulically operated interlocking device which selectively interconnects said first and third rocker arms in a manner wherein relative movement therebetween is prevented;

a first lost motion spring mounted on said first rocker arm and arranged to engage said second rocker arm in a manner which biases said second rocker arm against said second cam; and a second lost motion spring mounted on said first rocker arm and arranged to engage said third rocker arm in a manner which biases said third rocker arm against said third cam.

5. A valve train as claimed in claim 4 wherein said first and second hydraulically operated interlocking devices have first and second hydraulic control chambers and plunger means responsive to the pressure prevailing in the control chambers, respectively, and which further comprises, passage means formed in said first rocker arm and the rocker shaft on which the first rocker arm is pivoted for supplying a control pressure to said first and second control chambers.

6. A valve train as claimed in claim 4 further comprising a fourth rocker arm, said fourth rocker arm being arranged to be motivated by a fourth cam having a profile suited for a higher speed engine operation than said third cam, said fourth rocker shaft being pivotally mounted on said first rocker arm;

a third hydraulically operated interlocking device which selectively interconnects said first and fourth rocker arms in a manner wherein relative movement therebetween is prevented; and a third lost motion spring mounted on said first rocker arm and arranged to engage said fourth rocker arm in a manner which biases said fourth rocker arm against said fourth cam.

7. A valve train as claimed in claim 6 wherein said third hydraulically operated interlocking device has a third hydraulic control chamber and plunger means responsive to the pressure prevailing in the third control chamber, the third control chamber being fluidly communicated with said passage means.

* * * * *